United States Patent [19]

Swain

[11] Patent Number: 4,613,787

[45] Date of Patent: Sep. 23, 1986

[54] LAMPS FILAMENT SUPPORTS FOR TUNGSTEN HALOGEN INCANDESCENT

[75] Inventor: Reginald D. Swain, London, England

[73] Assignee: Thorn EMI Limited, London, England

[21] Appl. No.: 585,028

[22] Filed: Mar. 5, 1984

Related U.S. Application Data

[63] Continuation of Ser. No. 230,811, Feb. 2, 1981, abandoned.

[30] Foreign Application Priority Data

Feb. 6, 1980 [GB] United Kingdom ..... 8004025

[51] Int. Cl.[4] ..... H01K 1/18; H01K 3/06

[52] U.S. Cl. ..... 313/579; 445/32; 313/279

[58] Field of Search ..... 313/578, 579, 275, 279; 445/27, 32, 48

[56] References Cited

U.S. PATENT DOCUMENTS

| | | | |
|---|---|---|---|
| 2,032,791 | 3/1936 | Cartun | 313/279 X |
| 2,667,594 | 1/1954 | Hermanson et al. | 313/279 X |
| 2,712,089 | 6/1955 | Lamb | 313/279 X |
| 2,901,658 | 8/1959 | Pero et al. | 313/275 X |
| 3,466,489 | 9/1969 | Audesse et al. | 313/279 |
| 3,760,217 | 9/1973 | Martin et al. | 313/579 X |
| 4,096,408 | 6/1978 | Bozzay et al. | 313/457 X |

*Primary Examiner*—Palmer C. DeMeo
*Assistant Examiner*—Sandra L. O'Shea
*Attorney, Agent, or Firm*—Fleit, Jacobson, Cohn & Price

[57] ABSTRACT

A linear filament assembly for a halogen cycle or other incandescent lamp comprises a generally linear filament usually a coil or coiled coil, supported at opposite ends by substantially rigid conductive leads. A rigid insulating rod, preferably of quartz extends generally parallel to the filament, and a plurality of supports extend between the rod and the filament, each support being fixedly secured to the rod and supporting the filament. The supports are embedded in the rod, this being achieved by heating the rod at the point of insertion until it is sufficiently soft to insert the wire without excessively distorting the rod.

24 Claims, 6 Drawing Figures

LAMPS FILAMENT SUPPORTS FOR TUNGSTEN HALOGEN INCANDESCENT

This application is a continuation of application Ser. No. 230,811, filed Feb. 2, 1981 abandoned.

The present invention relates to supports for elongated filaments in incandescent lamps, and more especially in linear, halogen regenerative cycle lamps.

Elongated incandescent filaments require support along their length. In conventional halogen lamps, notably the linear tungsten-halogen lamp, a coiled filament is supported at intervals by spirals of refractory metal, usually tungsten, which fit loosely in the lamp tube and terminate in a coil which is secured into or otherwise meshes with the filament coil over two or three turns.

Essentially, the filament serves to retain the support in position, but this has several disadvantages. Firstly, the filament must be strong enough to be capable of holding the support: this limits the structure to lamps of relatively high power and correspondingly coarse filament. Secondly, on failure of the filament, the supports tend to collapse, causing the broken filament ends to draw apart and from an arc: this arc could explosively destroy the lamp, and a fuse is required to suppress it. There is also a risk that the hot filament ends may touch the tube wall and puncture it. Thirdly, there is considerable cooling of the filament over the region of contact with the support: this leads to an uneven temperature along the filament and to a shorter lamp life, owing to transport of the refractory metal from one point of the filament to another in accordance with the temperature gradients.

We have now found some or all of these disadvantages can be avoided if an elongated coiled filament is supported at intervals by support wires substantially rigidly mounted in the lamp envelope independently of the filament, each wire terminating in a coil of two or more turns having a pitch and diameter such that the support coil supports the filament without meshing therewith. Such supporting coil arrangement is disclosed and claimed in our copending European Patent application No. 80301645 (Publication No. 0020075).

The support coil preferably has a smaller pitch than the filament coil, and conveniently may have a pitch substantially equal to the diameter of the support wire itself.

The rigid mounting of the support wires is preferably achieved by securing the wires to a rigid insulating rod extending alongside or generally parallel to the filament coil. This rod may be made from quartz, high silica content glass (e.g. VYCOR—Trade Mark), high melting point aluminosilicate or borosilicate glass, or possibly an insulating ceramic. In a tungsten halogen lamp it is preferably of quartz or Vycor. The rod may be supported at its ends by supports secured in the pinch seal or seals of the lamp, or itself sealed directly into the pinch.

In the arrangement described in the aforementioned European Patent Application the wires are secured to the rod by means of coils formed in the wires which are push fit on the rod.

It is clearly important that the support wires be as firmly fixed in relation to the rod as can be achieved, consistent with efficient and sufficiently inexpensive manufacturing procedures. It is an object of this invention to provide an improved fixing of supports onto the rod of a lamp of this type.

According to the invention there is provided a linear filament assembly for an incandescent lamp, the assembly including a generally linear coiled filament, supported at opposite ends by substantially rigid conductive leads, a rigid refractory insulating rod extending generally parallel to the filament and a plurality of supports extending between the rod and the filament at spaced positions, each support supporting the filament coil and being secured to the rod by being embedded therein when the material of the rod is in softened state by heating.

The arrangement of this invention uses support wires which loosely embrace the filament coil, as in the said European Patent Application but instead of the support wires being so coiled around the rigid insulating rod each one is pushed into the rod at spaced positions. It has been known to secure supports of different types in glasses, which would be low melting point glass, by heating the glass to insert the rod or by drilling holes. It has not, however, previusly been proposed or appreciated that such a technique should be used with supporting rods of quartz or high melting point glasses or ceramics. The invention is particularly useful for a quartz rod.

The present technique heats the rod to soften it at the required positions, to about 1800° C. for the cases of quartz and Vycor (TM) and the wires are then forced into the rod in a direction longitudinal to the wires and radial to the rod. An inert gas, for example argon, may be blown around the wires during this operation, to minimize oxidation which can take place at about 400° C. to 500° C. and recrystallization of the metal of the wire. However this has not been found to be necessary. The exact temperature at which to insert each wire will be apparent to those skilled in working glass.

The procedure lends itself to automation which may take two preferred forms. In one form the support wire is taken from a reel and coiled in a standard automatic coiling device before being pushed into the rod at a point at which a heating flame is already playing on it. Automatic feed devices move either the rod or the coiling and fitting device to a new position after each operation. In an alternative enough wires, pre-coiled, for one lamp may be fitted into a former at the appropriate spacing and then introduced simultaneously to the rod at preheated points. This procedure generally has the supports fitted manually into the former but the other procedures may be automated and it does allow a single heating operation to be performed on the rod. Other procedures including combinations of these two may be used.

Immediately after the wires have been pressed into the rod, the heating flames are removed and the structure allowed to cool. Although some recrystallisation of tungsten near the quartz may occur in this process, it has been found that this does not cause a problem, since the wires are not under any great stress. At the ends of the rod, where greater stress can occur, wire supports for the rod may, if desired, be attached by means of a push-fit coil.

In order that the invention may be clearly understood and readily be carried into effect it will be described, by way of example, with reference to the accompanying drawings, in which, FIG. 1 shows a side elevation of a linear halogen lamp having spiral filament supports of known type;

Figure 1:
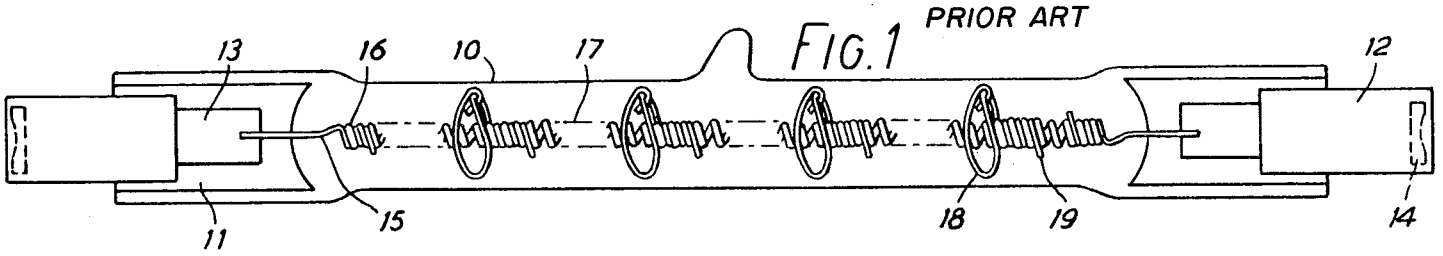
PRIOR ART FIG. 1

In the known lamp of FIG. 1, a tubular envelope 10 of quartz is sealed at each end with pinch seals 11 fitted with ceramic caps 12. Molybdenum foil strips 13 in the seals connect contacts 14 with filament leadwires 15, which terminate in screw coils 16, screwed into the ends of the coiled filament 17. The spaced filament supports 18 are spirals of, in this example, tungsten wire fitting loosely in the tube 10 and terminating axially in coils 19 which are wound into the filament coil and mesh over several turns.

Figure 2:
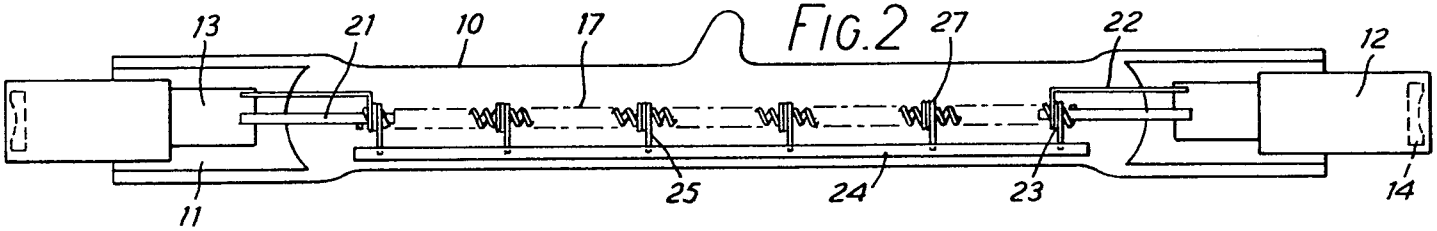
FIG. 2 is a similar view of a lamp having supports according to this invention.
Figure 3:
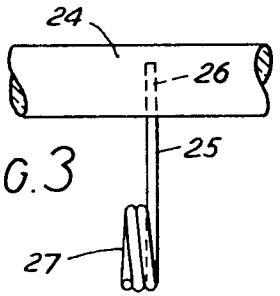
FIG. 3 is a side view.
Figure 4:
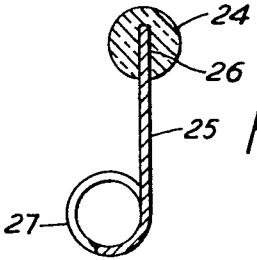
FIG. 4 is a cross-sectional view of the attachment of the filament support wires to the support rod.

In the preferred embodiment of the present invention, shown in FIGS. 2 to 4, solid screw plugs 21 are welded to the foil strips 13 and support the ends of the filament 17. Additionally, a wire support 22 is welded to each foil strip and is formed with a coil 23 which also supports the filament and terminals by being attached to the respective end of a quartz rod 24, which is supported thereby in a position generally parallel to the filament. Support wires 25 then extend from the quartz rod to support the filament at intervals along its length.

One end 26 of each support wire 22 and 25 is secured to the rod 24 by being pressed preferably at least half way into the heat-softened rod by the technique already described. The other end of each support 25 terminates in a coil 27 which, as is coil 23, is of smaller pitch but greater diameter than the filament coil, and loosely embraces the filament coil to give it the necessary support, while keeping metal-to-metal contact and thus the possibility of heat conduction, to a minimum.

As an alternative the wires 22 may each terminate in a coil, not shown, which is a push fit on the respective end of the rod 24, but that is not preferred.

The filament assembly according to the invention is easily constructed, and gives a firm support. The rod 24, with the support wires 25 secured in it, can receive the filament by lowering the latter through the aligned coils 26. With the wire supports 22, filament plugs 21 and foil strips 13 attached, this constitutes a rigid assembly in which the filament can be tensioned as desired and the assembly then simply inserted into the lamp tube.

In practical experiments it has been found that, whereas 200 W lamps at a loading of 15 Lumens/Watt would be expected to have a life of 2000 hours, lamps of this rating embodying the invention, which we have tested, have had lives exceeding 5000 hours.

It has been mentioned that the invention is particularly useful with a quartz rod which will generally be between 1.35 and 2.5 mm diameter preferably 1.5 mm. Wire of typically under 10 thousandths of an inch diameter, should be inserted at least half way into the rod.

Figure 5:
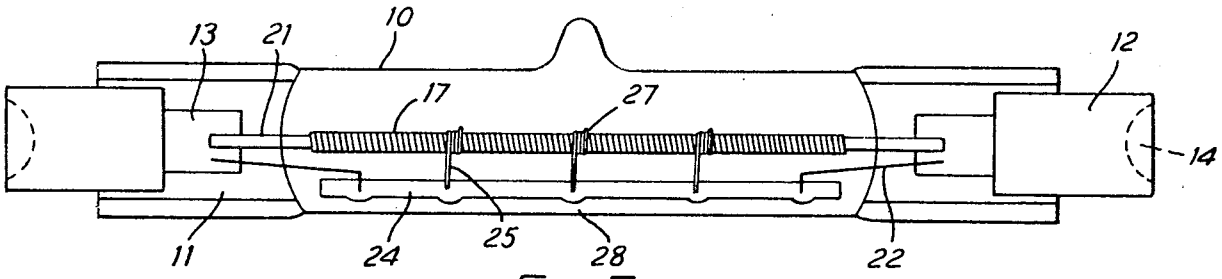
FIG. 5 shows a smaller lamp of the same general type and FIG. 6 shows the lamp of FIG. 5 jacketed in an outer envelope as a single ended lamp.

The lamp illustrated in FIG. 2 is a 200 watt tungsten-halogen filament lamp in which the supports for the filament are spaced at about 12 mm. Clearly the invention is applicable to other sizes of lamp and FIG. 5 shows a smaller lamp in which a smaller and lighter filament is supported by a reduced number of supports 25 at about the same spacing. In the example the supports 22 do not engage the filament but support the rod 24 directly to the foils 13. This arrangement may also be used on larger lamps. In FIG. 5 there can be seen protruberences 28 caused by distortion of the hot quartz when support wires 25 are inserted. Although these are not of themselves disadvantageous they should be kept to a minimum if only to maintain clearance in the envelope 10. By careful control of the quartz temperature and insertion pressure these protruberances 28 can be reduced to insignificant size. The size of the quartz rod may be varied with the power of the lamp but will usually not exceed 2.5 mm diameter except for lamps over 500 watts.

Figure 6:
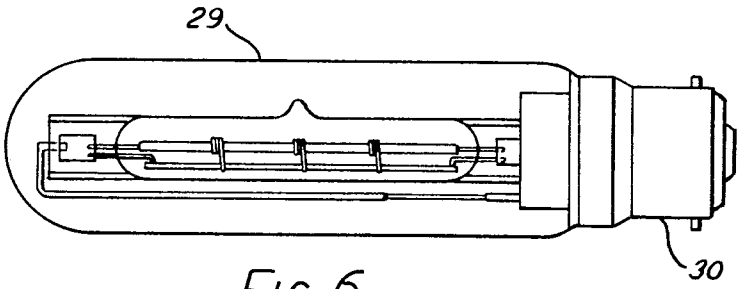

The lamps are generally used double ended, for example in floodlights. They may, however, be provided as in FIG. 6 in which the lamp of FIG. 5 is jacketed in an outer envelope 29 to fit a single ended lamp base 30.

The invention may also be applied to lamps other then tungsten halogen lamps, where there is a requirement to support an elongated filament on a quartz or other high melting point glass rod.

The support wires may be of material other than tungsten, for example Molybdenum, Tantalum or doped Vanadium.

What we claim is:

1. A linear filament assembly for a tungsten halogen incandescent lamp, the assembly including a generally linear coiled filament, a rigid insulating rod of refractory material selected from the group consisting of quartz, high silica content glass, high melting point alumino-silicate or borosilicate glass, or ceramic extending generally parallel to the filament and a plurality of support wires extending between the rod and the filament at spaced positions, each support wire having a diameter of less than about ten thousandths of an inch and having two ends, one end forming a support contacting the filament and the other end being secured to the rod by having been embedded in said rod when the material of the rod was in a softened state by heating.

2. A filament assembly according to claim 1 in which the supports are embedded at one end thereof into the rigid rod.

3. A filament assembly according to claim 1 or claim 2 in which the rigid rod is made of quartz.

4. A filament assembly according to claim 1 or claim 2 in which the rigid rod is made of high melting point glass.

5. A filament assembly according to claim 1 in which at least some of the supports include a support coil of two or more turns of substantially the same diameter, the pitch and diameter of the turns being chosen such that the support coil loosely embraces and supports the filament coil without meshing therein.

6. A filament assembly according to claim 1 including at each end of the rigid rod a further support transversely embedded in the rod and itself supported by the conductive leads to support said rod.

7. An incandescent lamp including a linear filament assembly according to claim 1.

8. A halogen cycle incandescent lamp including a linear filament assembly according to claim 6.

9. A method of assembling a linear filament assembly, for a tungsten halogen lamp, the method comprising the steps of providing a generally linear coiled filament, a rigid insulating rod of refractory material selected from the group consisting of quartz, high silica content glass, high melting point aluminosilicate or borosilicate glass, or ceramic extending generally parallel to the filament, and a plurality of support wires extending between the rod and the filament to be secured to the rod and to support the filament, said support wires each having a diameter less than about ten thousandths of an inch, heating the rod at selected points until sufficiently plastic to insert the support wires in th rod, and embedding a support wire in the rod at each said point in a direction longitudinal to the wires.

10. A method according to claim 9 in which the rod is heated at each point by a respective flame which is withdrawn when the respective wire has been inserted.

11. A tungsten halogen incandescent filament lamp having a generally linear coiled filament supported at opposite ends by substantially rigid conductive leads, a rigid insulating rod of refractory material selected from the group consisting of quartz, high silica content glass, high melting point aluminosilicate or borosilicate glass, or ceramic extending generally parallel with the filament and a plurality of support wires extending between the filament and the rod at spaced positions along the rod, each support wire having a diameter of less than about ten thousandths of an inch and supporting the filament and having an end whereby said support wire is secured to the rod by said end being embedded therein when the rod is in a softened state by being heated to a temperature substantially greater than the oxidation temperature of the support wires.

12. A tungsten halogen incandescent filament lamp comprising:

a tubular quartz envelope; a generally linear coiled filament disposed in the envelope; substantially rigid conductive leads supporting the filament at opposite ends thereof; sealing foil strips, sealed in pinch seals at opposite ends of the envelope and to which the said conductive leads are electrically connected; additional support wires connected between each foil strip and respective ends of said coiled filament; a rigid insulating rod of refractory material selected from the group consisting of quartz, high silica content glass, high melting point aluminosilicate or borosilicate glass, or ceramic extending generally parallel to the filament and support at the ends of the envelope; and a plurality of support wires extending between the filament and the rod at points spaced along the rod, each support wire having a diameter of less than about ten thousandths of an inch and having two ends, one end supporting the filament and the other end being secured to the rod by having been embedded therein when the rod was in a softened state by heating at said spaced points.

13. A tungsten halogen incandescent filament lamp in accordance with claim 11 wherein the rod has protuberances at said spaced point along the rod on the side of the rod opposite the points of entry of the support wires.

14. A linear filament assembly for a tungsten halogen incandescent lamp according to claim 1, wherein the linear filament assembly is substantially rigid.

15. A method of assembling a linear filament assembly for a tungsten halogen incandescent lamp according to claim 9, wherein said lamp includes a tubular quartz envelope and said method includes the step of tensioning said filament prior to the insertion of said filament assembly into said tubular quartz envelope.

16. A method of assembling a linear filament assembly for a tungsten halogen incandescent lamp according to claim 9, wherein said selected points are heated to about 1800° C.

17. A tungsten halogen incandescent filament lamp according to claim 12, said lamp including a filament support assembly comprising said substantially rigid conductive leads, said rigid insulating rod and said support wires embedded in said rigid insulating rod, and wherein said filament support assembly is disposed within said quartz tubular envelope clear of said envelope.

18. A tungsten halogen incandescent lamp according to claim 11, wherein the rod has a diameter of from about 1.35 mm to about 2.5 mm.

19. A tungsten halogen incandescent lamp according to claim 18, wherein the lamp has a power rating not exceeding 500 watts.

20. A tungsten halogen incandescent lamp according to claim 18, wherein the rod has a diameter of substantially 1.5 mm.

21. A tungsten halogen incandescent lamp according to claim 11, wherein the support wires are embedded at least halfway into the rod.

22. A tungsten halogen incandescent lamp according to claim 11, wherein the support wires are made of material selected from the group consisting of tungsten, molybdenum, tantalum, and doped vanadium.

23. A tungsten halogen incandescent filament lamp comprising: a tubular quartz envelope; and electrically conductive contact at each end of the envelope; a generally linear coiled filament carried with the envelope and supported at opposite ends by substantially rigid conductive leads electrically connected with respective ones of the contacts; a rigid quartz insulating rod supported within the envelope in spaced relationship to and extending generally parallel with the filament, the rod having a diameter of from about 1.35 mm to about 2.5 mm; and a plurality of support wires extending between the filament and the rod at longitudinally spaced positions along the rod, each support wire supporting the filament and having a first end formed as a coil to support the filament and having a second end embedded within the rod, the support wires each having a diameter of less than about ten thousandths of an inch and extending radially into the rod to a depth of at least half the rod diameter.

24. A tungsten halogen incandescent filament lamp according to claim 23 wherein the diameter of the quartz rod is about 1.5 mm.

* * * * *